US007353938B2

(12) United States Patent
Moldolan

(10) Patent No.: US 7,353,938 B2
(45) Date of Patent: Apr. 8, 2008

(54) ACCIDENT IDENTITY KIT

(76) Inventor: Eytan Moldolan, 11516 Dona Cecilia Dr., Studio City, CA (US) 91604

( * ) Notice: Subject to any disclaimer, the term of this patent is extended or adjusted under 35 U.S.C. 154(b) by 738 days.

(21) Appl. No.: 10/287,950

(22) Filed: Nov. 4, 2002

(65) Prior Publication Data

US 2003/0094385 A1 May 22, 2003

Related U.S. Application Data

(60) Provisional application No. 60/332,036, filed on Nov. 20, 2001.

(51) Int. Cl.

| | |
|---|---|
| ***B65D 69/00*** | (2006.01) |
| ***B65D 85/38*** | (2006.01) |
| ***B65D 73/00*** | (2006.01) |
| ***A45C 11/38*** | (2006.01) |

(52) U.S. Cl. ..... 206/232; 206/578; 206/214; 206/316.2; 206/473

(58) Field of Classification Search ..... 206/38, 206/232, 573, 575, 576, 578, 214, 224, 316.2, 206/371, 472, 473, 570, 803; 190/11; 294/146, 294/139, 149; 150/147–149; 281/31
See application file for complete search history.

(56) References Cited

U.S. PATENT DOCUMENTS

| | | | | |
|---|---|---|---|---|
| 3,301,295 | A * | 1/1967 | Fitch | 206/570 |
| 5,348,347 | A * | 9/1994 | Shink | 281/31 |
| 5,483,442 | A * | 1/1996 | Black et al. | 700/90 |
| 5,992,620 | A * | 11/1999 | Holtom | 206/232 |

OTHER PUBLICATIONS http://autobodypro.com/press_rls/0017.htm, Aug. 20, 2001.*
http://www.crashmate.co.uk/product.htm□□archive date Apr. 21, 2001□□CRASHMATE Trademark filed Apr. 25, 2000.*
http://www.survivalinstinct.com/aut.html□□archive date Apr. 22, 2000.*
http://theplan.com/planpub/cat/vamp.html□□archive date May 6, 1999.*
Birmingham 101, THE Online Magazine, Local News Oct. 24, 2000, Local Trio Launch At Motoshow.*

* cited by examiner

*Primary Examiner*—J. Gregory Pickett
(74) *Attorney, Agent, or Firm*—Greenberg Traurig, LLP

(57) ABSTRACT

A documentation kit including a panel with transparent pockets for receiving documentation on the left hand side a camera and other harder solid elements in the central portion, and documentation on the left hand side. The flaps are closable over the central portion and can be closed with Velcro™.

4 Claims, 4 Drawing Sheets

ACCIDENT IDENTITY KIT

This application claims benefit of provisional application 60/332,036, filed Nov. 20, 2001.

BACKGROUND OF THE INVENTION

1. Field of the Invention

This invention relates to motor vehicle accidents, and more particularly to systems for documenting and recording issues relating to motor vehicle accidents at the site.

When an automobile accident occurs there is a lot of stress and shock and possibly injury or worse. Documenting of the circumstances of such accidents for insurance or legal purposes is typically inadequate. It is useful to provide material in an easily accessible form to enable the accurate recordal of events associated with the accident. This can assist authorities, insurance companies, and the parties in resolving issues and possibly avoiding conflicting events.

Different kits are known for provision in an automobile or the like.

Some kits are known to document accidents but they are complex and not user friendly.

This invention is directed to overcoming the limitation of existing kits and to the provision of a kit which is useful, easy to use and has essential contents to effectively document accidents. At the same time the kit is relatively inexpensive.

SUMMARY OF THE INVENTION

The invention provides for at least one wallet like device. In the wallet there are pockets for holding one or more devices or units for recording characteristics of an accident. The wallet is preferably formed of plastic and the pockets are, at least in part, formed of a transparent element. The pockets could be welded around the edges to a plastic base and provide different sizes to hold the elements of the document identification kit. The weldings are preferably effected on three sides and there is one open side to receive components. Additionally, one or more elasticized loops are provided in the wallet for holding other elements of the kit.

Preferably the wallet is formed of essentially three substantially equal component parts, a central part for holding the more solid components of the kit, and two flat parts on either side for holding documentation. The areas between the central part and the flat part can hold one or more elongated members of the kit.

The invention is directed to a panel for an identification kit, the panel being foldable in two places thereby to be in folded format of at least three portions being a central portion and two side portions, one to either side of the central portion. There are means for receiving documentation on one side portion; means for receiving a camera in the central portion; means for receiving a battery; means for receiving a writing instrument; and means for receiving a measuring tape.

The panel including identification kit material which comprises the camera, a battery, a flashlight, writing instrument, documentation, a measuring tape, and a whistle. The contents are laid out with documentation paperwork in two flat side portions, and the battery, writing instrument and measuring tape being arranged around the camera. Some of the components, preferably elongated components such as the writing instrument are in the spine area between the first side portion and the central portion, and the spine area between the second side portion and the central portion.

The invention's further described with reference to the accompanying drawings.

DETAILED DESCRIPTION OF THE DRAWINGS

Figure 1:
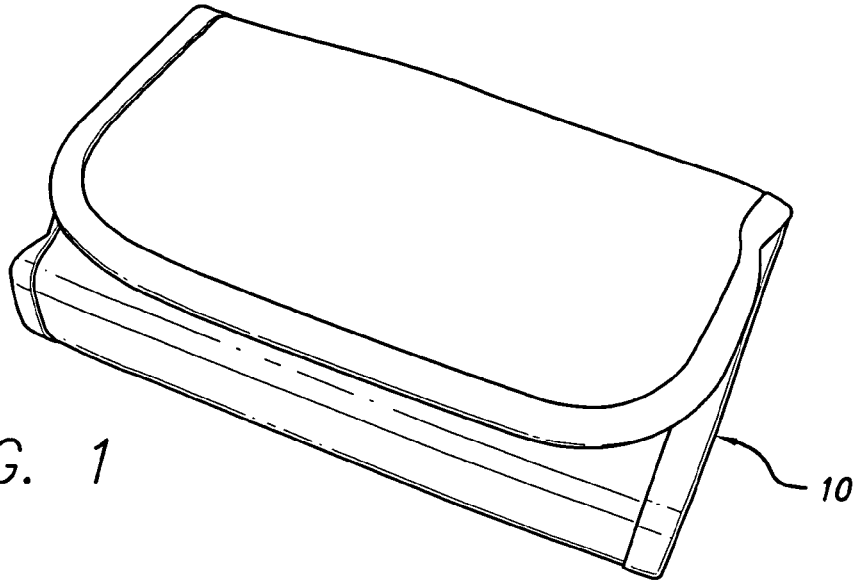
FIG. 1 is a representation of the wallet in closed format viewed from the front.
Figure 2:
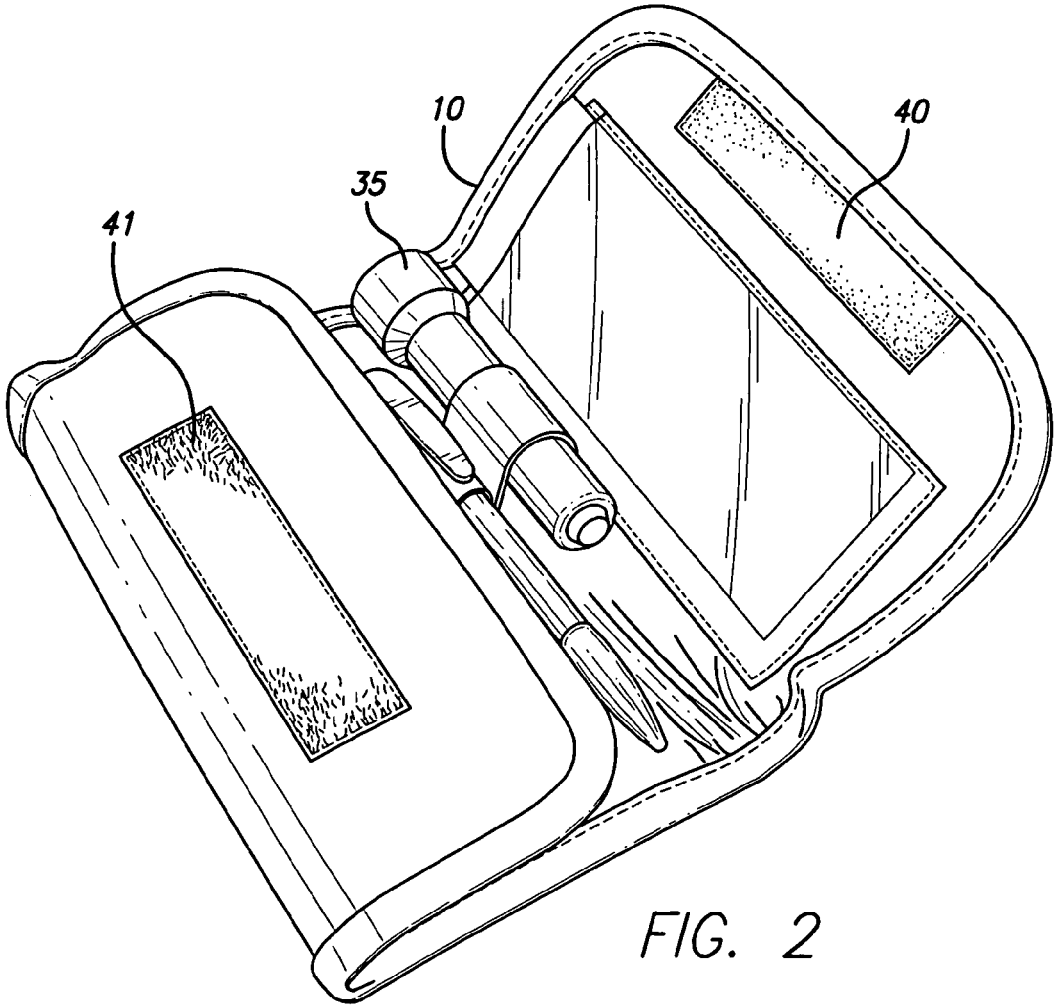
FIG. 2 is a view partially open.

A plastic base 10 measuring about twelve inches long by six inches wide is provided to form the flat area for holding the different elements of the accident identity kit. The top face 11 has rounded corners 12 and there is an appropriate trim around the outside of the corners. On the face 11 there is a central portion 13 a left handed portion 14 and a right handed portion 15. Between the portions 13 and 14 there is a spine-like rounded portion 16 and between the portion 13 and 15 there is a spine-like rounded portion 17.

On the left hand side 14 there is a transparent pocket 18 which is welded on three sides 19, 20 and 21 and has an open mouth 22. Inside that pocket there is a card 23 for indicating information about the insurance and registration of the car. If necessary this card can be removed by the user.

On the right hand side 15 there is another transparent pocket 24 which is welded on sides 25, 26 and 27 and open at the top 28. Within this pocket which is relatively longer than the pocket on the left hand flap there is a page 29 which has the necessary information that a person can complete for details about an accident In the spine sections 16 and 17 respectively there are elasticized bands 30*a*, 30*b* and 31 for receiving one or more elements of the kit. In the left hand elasticized band there is contained a tape measure 32. This can be of a foldable kind and can be of plastic, paper or other suitable material.

Figure 3:
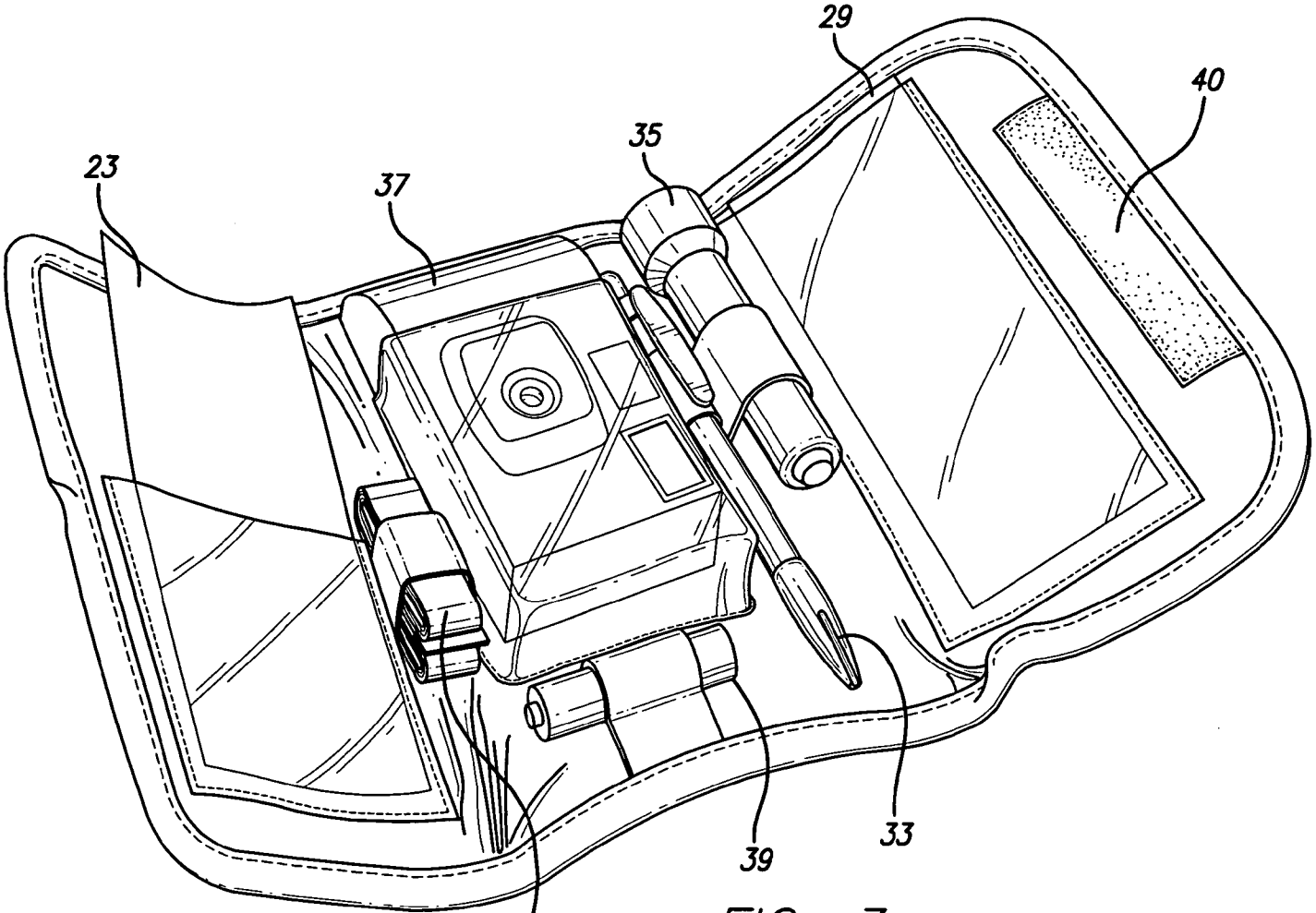
FIG. 3 is a view of the wallet opened up to show all the components for location inside the wallet.
Figure 4:
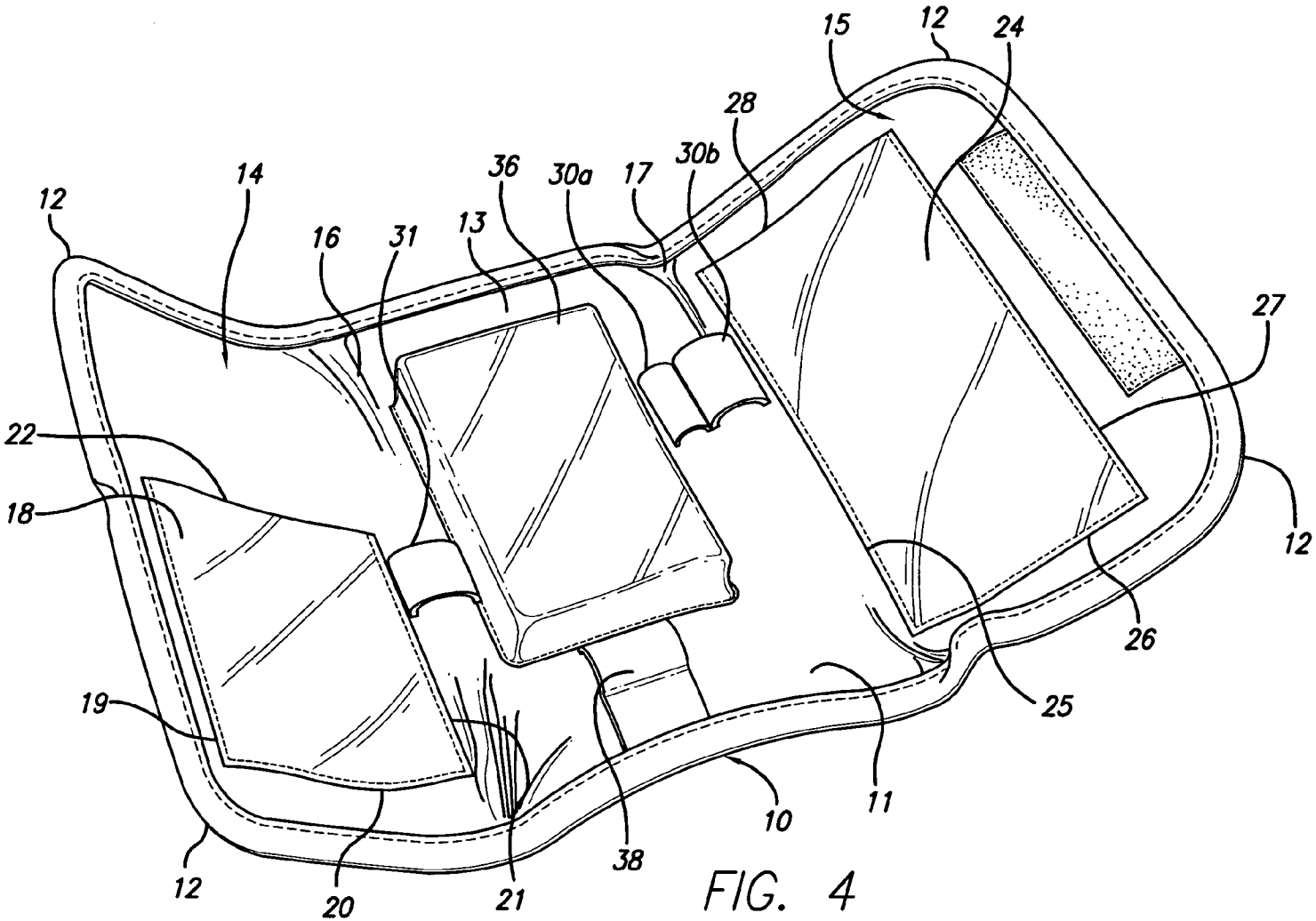
FIG. 4 is a front face view with the wallet open and empty.
Figure 5:
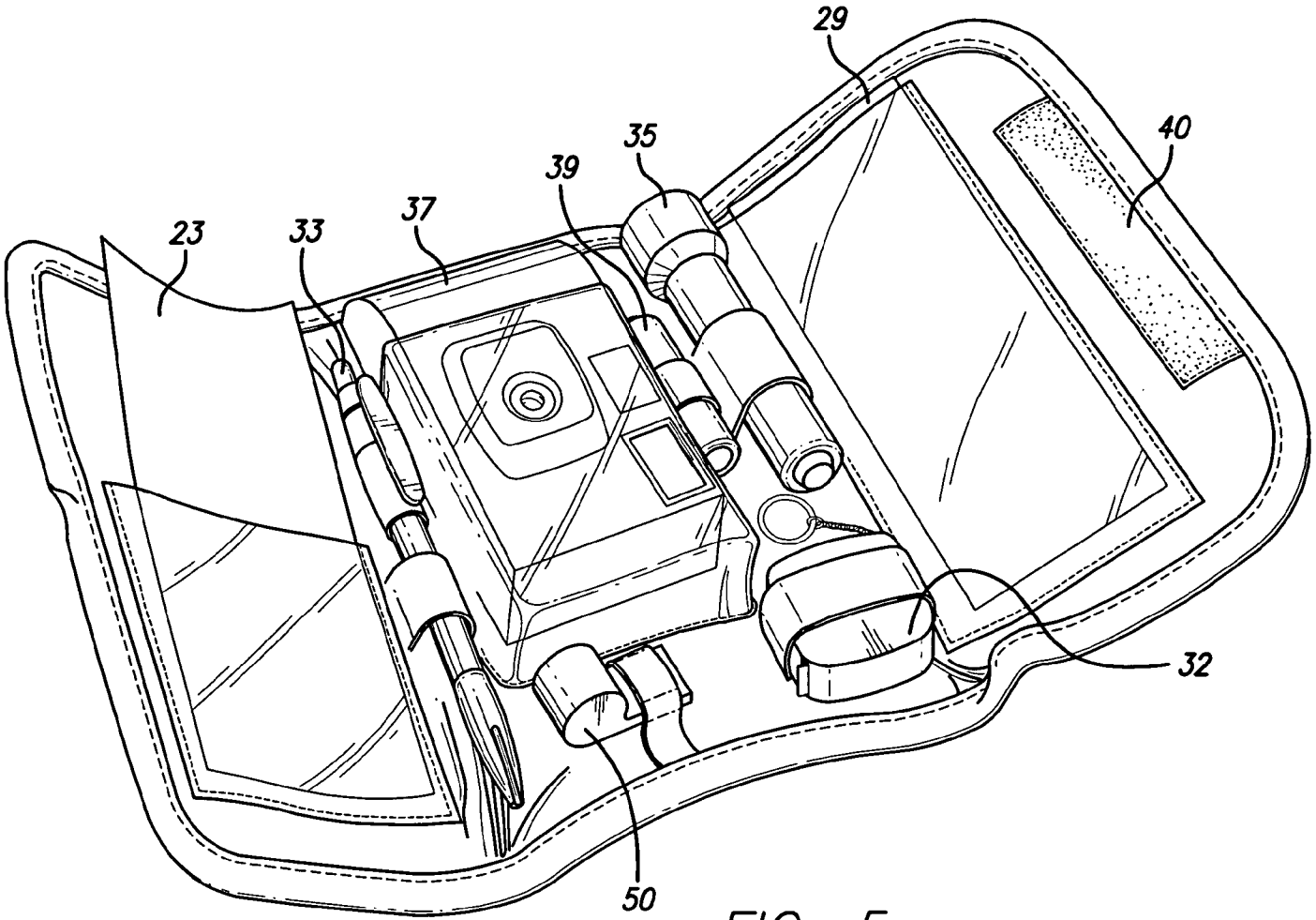
FIG. 5 is a view of a different embodiment of the wallet opened up to show all the components for location inside the wallet.

In the embodiment of FIG. 5 the arrangement is different to that of FIG. 3, and a whistle 50 is also provided at the location otherwise occupied by the battery. The pen 33 is located in the opposite spine portion, the tape 32 is located in the central portion below the camera 37, and the battery 39 is located where the pen otherwise would have been located. The overall structure of the kit is that in both the spine areas there are elongated elements to conform generally with the spine direction. Additionally the flashlight diameter is about equal to the depth of the camera. This ensures that in the folded arrangement there is obtained a neat rectangular like package format for the kit In the spine section 17 under the band 30*a* there is a pen 33. Adjacent to the band 30*b* is the elasticized band 30*b* for locating a flashlight parallel to the pen 33. The pen 33 is more located in the central area and the flashlight 35 is more in the spine section.

In the central portion 13 of the panel there is the transparent pocket 36 which is welded along three sides. This pocket is relatively larger and is sufficient to hold a camera 37. The camera is already filled with film. Below the pocket 36 there is an elasticized band 38 which can hold a battery 39 in a transverse relationship below the base of the camera.

At the one edge there is a Velcro™ strip 40 which has hooks or loops and this is for engagement with the mating hooks or loops 41 on the outside face of the panel. The outside face is opposite to the panel face 11. This effectively closes the kit as such. The kit is folded in thirds and is a convenient package for fitting in a glove compartment.

Many other forms of the invention exist each differing from the other in matters of detail only.

Ideally the kit contains a re-loadable camera with a flash, flashlight with batteries, ball-point pen, a bilingual auto accident form, a measuring tape, photo instruction information, emergency number information, insurance and vehicle registration card, and in FIG. 5 there is a whistle.

With this invention and using this kit in a vehicle, it is easy for persons involved in an accident to recall details about an accident. There is less worry and confusion and the documentation is easy to complete and is relatively easily handy. The back face of the kit provides a useful surface when expanded or open so that it can be laid out on a surface, for instance a car hood, with everything easily accessible. With this arrangement the components are readily handy. The form 23 on the left hand side is used to provide instructions of completing the form on the right hand side. The tools for measuring and taking data from the accident scene and event are set out in the middle of the kit. The back or outside surface of the kit is of a nature that it will not easily slip off surfaces. Sufficient tackiness or friction is provided by the back surface or the parts of the surface which engages the underlying base, such as a smooth car hood, that slippage is inhibited. On the other hand it can be easily closed and packaged in a glove container.

What claimed is:

1. A panel for an identification kit, the panel being foldable in two places thereby to be in folded format of at least three portions being a central portion and two side portions, one to either side of the central portion:

means for receiving documentation on one side portion;

means for receiving a camera in the central portion;

means for receiving a battery;

means for receiving a writing instrument;

means for receiving a measuring tape;

identification kit material comprising a camera, a battery, a flashlight, writing instrument, documentation and a measuring tape; and the panel being formed in three portions, and the contents being laid out with documentation paperwork in two flat side portions, and the battery, writing instrument and measuring tape being arranged around the camera, some of the components being in the spine area between the first side portion and the central portion, and the spine area between the second side portion and the central portion, and the first and second portions being opposite each other with the central portion between them.

2. A kit including a panel, the panel being foldable in at least two places so as to be in folded format of three portions, the panel comprising:

means for receiving documentation;

means for receiving a camera;

means for receiving a battery;

means for receiving a writing instrument;

means for receiving a measuring tape;

a camera, a flashlight, writing instrument, documentation and measuring tape; and the contents being laid out with paperwork in the two flat side portions, the camera in a central portion, and other components being arranged around the camera, at least some of the components being in the spine area between a first side portion and a central portion, and a second side portion and a central portion.

3. A document identification kit comprising:

a panel foldable in two places thereby to be in folded format of at least three portions being a central portion and two side portions, one to either side of the central portion:

a pocket for receiving first documentation on one side portion, the first documentation including instructions for completion of a second documentation;

a pocket for receiving documentation on the second side portion, the second documentation having spacings for completion by a user; and an area for receiving multiple components used in measuring and recording details of an accident, a pocket for receiving a camera in the central portion;

means for receiving a battery;

means for receiving a writing instrument;

means for receiving a measuring tape;

means for receiving a whistle;

a camera;

battery with a flashlight;

writing instrument;

documentation;

measuring tape;

a whistle; and wherein the contents are laid out with documentation in two flat side portions, and the battery, writing instrument, measuring tape and whistle are arranged around the camera, and at least one elongated component is in the spine area between the first side portion and the central portion.

4. A document identification kit including a panel, the panel being foldable in two places thereby to be in folded format of at least three portions being a central portion and two side portions, one to either side of the central portion:

a pocket for receiving a camera in the central portion;

a pocket for receiving first documentation on one side portion, the first documentation including instructions for completion of a second documentation;

a pocket for receiving documentation on the second side portion, the second documentation having spacings for completion by a user;

an area for receiving multiple components used in measuring and recording details of an accident;

means for receiving an elongated instrument along the spine between the central portion and a side portion;

means for receiving a writing instrument;

means for receiving a measuring tape;

a camera;

battery with a flashlight;

writing instrument;

documentation;

measuring tape; and wherein the contents are laid out with documentation in two flat side portions, and the flashlight with battery, writing instrument and measuring tape arranged around the camera, and at least one elongated component is in a spine area between the first side portion and the central portion, another elongated component is in a spine area between the second side portion and the central portion, and the thickness of at least one of the elongated components in one some area is approximately equal to the thickness of the camera.

* * * * *

UNITED STATES PATENT AND TRADEMARK OFFICE

CERTIFICATE OF CORRECTION

PATENT NO. : 7,353,938 B2
APPLICATION NO. : 10/287950
DATED : April 8, 2008
INVENTOR(S) : Eytan Moldovan It is certified that error appears in the above-identified patent and that said Letters Patent is hereby corrected as shown below:

Title Page, under item (12) Column 1, at line 2, please delete "Moldolan" and insert --Moldovan--.

Title Page, Column 1 under Item [75] entitled "Inventor," please delete "Eytan Moldolan" and insert --Eytan Moldovan--.

Signed and Sealed this

Fifteenth Day of July, 2008

JON W. DUDAS
*Director of the United States Patent and Trademark Office*